US010543982B2

(12) United States Patent
Kral et al.

(10) Patent No.: US 10,543,982 B2
(45) Date of Patent: Jan. 28, 2020

(54) WASTE RECEPTACLE

(71) Applicant: Magnuson Group, Inc., Woodridge, IL (US)

(72) Inventors: Craig A. Kral, Buffalo Grove, IL (US); Daniel J. Merkle, Downers Grove, IL (US)

(73) Assignee: Magnuson Group Inc., Woodridge, IL (US)

( * ) Notice: Subject to any disclaimer, the term of this patent is extended or adjusted under 35 U.S.C. 154(b) by 200 days.

(21) Appl. No.: 15/602,561

(22) Filed: May 23, 2017

(65) Prior Publication Data

US 2018/0339855 A1 Nov. 29, 2018

(51) Int. Cl.
*B65F 1/16* (2006.01)

(52) U.S. Cl.
CPC ..... *B65F 1/163* (2013.01); *B65F 1/1646* (2013.01)

(58) Field of Classification Search
CPC ..... B65F 1/163; B65F 1/1646
USPC ..... 220/262–264, 908
See application file for complete search history.

(56) References Cited

U.S. PATENT DOCUMENTS 5,704,511 A 1/1998 Kellams
5,881,896 A 3/1999 Presnell
5,884,556 A 3/1999 Klepacki
5,890,615 A 4/1999 Petras
6,010,024 A 1/2000 Wang
6,024,238 A 2/2000 Jaros
6,267,260 B1 7/2001 Lyons
6,378,721 B1 4/2002 Williams
6,386,386 B1 5/2002 George
6,390,321 B1 5/2002 Wang
D476,457 S 6/2003 Verbeek
D476,458 S 6/2003 Lin
6,590,146 B1 7/2003 Mrsny
6,626,317 B2 9/2003 Pfiefer
D481,508 S 10/2003 Wang
D482,833 S 11/2003 Lin
D488,604 S 4/2004 Yang
D490,583 S 5/2004 Yang
D490,954 S 6/2004 Brand
D491,707 S 6/2004 Lin
D493,930 S 8/2004 Wang
6,901,974 B2 6/2005 Chomik
D513,445 S 1/2006 Lin
6,983,685 B2 1/2006 Ko
6,991,127 B2 1/2006 Huang
6,994,247 B2 2/2006 Richards
7,000,796 B2 2/2006 Goritzka
D518,266 S 3/2006 Yang
(Continued)

*Primary Examiner* — James N Smalley
(74) *Attorney, Agent, or Firm* — Fitch, Even, Tabin & Flannery, LLP

(57) ABSTRACT

A waste receptacle is provided herein having a linkage assembly extending from a foot operated actuator near a lower end of the waste receptacle body to the lid at an upper end of the body. In accordance with one form, the foot operated actuator may be configured to pivot about a pivot point internal to the waste receptacle housing such that the foot operated actuator and corresponding linkage does not penetrate or otherwise require a slot or opening in the body of the waste receptacle for operation. The linkage assembly may also include one or more shock absorbing portions intermediate the lid and the foot operated actuator.

19 Claims, 10 Drawing Sheets

(56) References Cited

U.S. PATENT DOCUMENTS

| | | | |
|---|---|---|---|
| D520,704 | S | 5/2006 | Lin |
| 7,070,064 | B1 | 7/2006 | Henry |
| 7,077,283 | B2 | 7/2006 | Yang |
| 7,086,569 | B2 | 8/2006 | Stravitz |
| D528,726 | S | 9/2006 | Lin |
| D530,477 | S | 10/2006 | Lin |
| D532,950 | S | 11/2006 | Lin |
| D532,952 | S | 11/2006 | Lin |
| D534,328 | S | 12/2006 | Lin |
| D537,601 | S | 2/2007 | Lin |
| 7,178,314 | B2 | 2/2007 | Chomik |
| D542,994 | S | 5/2007 | Lin |
| D543,673 | S | 5/2007 | Yang |
| 7,264,133 | B2 | 9/2007 | Yang |
| D562,522 | S | 2/2008 | Daams |
| D568,570 | S | 5/2008 | Lin |
| D568,571 | S | 5/2008 | Lin |
| D571,520 | S | 6/2008 | Lin |
| D572,423 | S | 7/2008 | Lin |
| D578,722 | S | 10/2008 | Yang |
| D581,622 | S | 11/2008 | Presnell |
| D586,069 | S | 2/2009 | Lin |
| D586,070 | S | 2/2009 | Lin |
| 7,484,635 | B2 | 2/2009 | Yang |
| 7,494,022 | B2 | 2/2009 | Buchalter |
| 7,530,578 | B2 | 5/2009 | Niemeyer |
| D595,468 | S | 6/2009 | Liao |
| 7,540,396 | B2 | 6/2009 | Yang |
| 7,578,024 | B2 | 8/2009 | Hughes |
| D605,822 | S | 12/2009 | Cantrell |
| D606,272 | S | 12/2009 | Cantrell |
| 7,703,622 | B1 | 4/2010 | Bynoe |
| D615,270 | S | 5/2010 | Yang |
| 7,748,556 | B2 | 7/2010 | Yang |
| 7,798,358 | B2 | 9/2010 | Butler |
| D625,068 | S | 10/2010 | Shannon |
| 7,832,587 | B2 | 11/2010 | West |
| D630,404 | S | 1/2011 | Yang |
| D631,221 | S | 1/2011 | Yang |
| 7,874,446 | B2 | 1/2011 | Spivey |
| 7,878,358 | B2 | 2/2011 | Smudde |
| 7,878,359 | B1 | 2/2011 | Ko |
| D634,911 | S | 3/2011 | Yang |
| 7,922,024 | B2 | 4/2011 | Yang |
| D638,598 | S | 5/2011 | Ziech |
| 7,950,543 | B2 | 5/2011 | Yang |
| D644,390 | S | 8/2011 | Smeets |
| 7,992,742 | B1 | 8/2011 | Kim |
| 7,999,688 | B2 | 8/2011 | Healey |
| 8,006,857 | B2 | 8/2011 | Lin |
| D644,806 | S | 9/2011 | Yang |
| D644,807 | S | 9/2011 | Yang |
| 8,061,554 | B2 | 11/2011 | Shikano |
| 8,074,833 | B2 | 12/2011 | Yang |
| 8,087,532 | B2 | 1/2012 | Brown |
| 8,091,325 | B2 | 1/2012 | Stravitz |
| 8,132,872 | B2 | 3/2012 | Prosa |
| 8,136,688 | B2 | 3/2012 | Lee |
| 8,157,159 | B2 | 4/2012 | Al-Hadhoud |
| 8,266,871 | B1 | 9/2012 | Stravitz |
| D668,414 | S | 10/2012 | McNay |
| 8,297,470 | B2 | 10/2012 | Yang |
| 8,448,803 | B2 | 5/2013 | Most |
| 8,456,120 | B2 | 6/2013 | Wang |
| 8,522,993 | B2 | 9/2013 | Flewelling |
| 8,540,106 | B2 | 9/2013 | Banus |
| 8,567,630 | B2 | 10/2013 | Yang |
| 8,584,886 | B1 | 11/2013 | Ellman |
| 8,613,371 | B2 | 12/2013 | Rousso |
| 8,678,219 | B1 | 3/2014 | Wang |
| 8,695,834 | B2 | 4/2014 | Panek |
| 8,720,728 | B2 | 5/2014 | Yang |
| 8,752,723 | B2 | 6/2014 | Lucas |
| 8,771,606 | B2 | 7/2014 | Sun |
| 8,833,588 | B2 | 9/2014 | Spahmann |
| 8,845,970 | B2 | 9/2014 | Muderick |
| D716,015 | S | 10/2014 | van de Leest |
| D717,012 | S | 11/2014 | Han |
| D717,013 | S | 11/2014 | Han |
| D717,015 | S | 11/2014 | Han |
| 8,910,821 | B1 | 12/2014 | Stravitz |
| 8,947,022 | B2 | 2/2015 | Shek |
| D725,861 | S | 3/2015 | Yang |
| D729,485 | S | 5/2015 | Yang |
| D730,008 | S | 5/2015 | Yang |
| 9,027,779 | B2 | 5/2015 | Friedman |
| 9,033,176 | B2 | 5/2015 | Liistro |
| 9,056,716 | B1 | 6/2015 | Stravitz |
| 9,067,732 | B2 | 6/2015 | Wang |
| 9,089,318 | B2 | 7/2015 | Henniges |
| 9,102,467 | B2 | 8/2015 | Chomik |
| 9,161,874 | B2 | 10/2015 | Pennings |
| D743,138 | S | 11/2015 | Sun Ting Kung |
| D774,270 | S | 12/2016 | Chen |
| D793,642 | S | 8/2017 | Yang |
| D795,521 | S | 8/2017 | Han |
| D804,133 | S | 11/2017 | Yang |
| 2004/0016756 | A1* | 1/2004 | Lin ..... B65F 1/163 220/263 |
| 2005/0224496 | A1 | 10/2005 | Moyer |
| 2006/0186121 | A1 | 8/2006 | Yang |
| 2006/0243731 | A1 | 11/2006 | O'Brien |
| 2006/0283929 | A1 | 12/2006 | Lim |
| 2007/0089688 | A1 | 4/2007 | Nitzsche |
| 2007/0181579 | A1 | 8/2007 | Kuo |
| 2007/0295722 | A1 | 12/2007 | Titas |
| 2008/0006638 | A1 | 1/2008 | Yang |
| 2008/0023474 | A1 | 1/2008 | Yang |
| 2008/0105680 | A1 | 5/2008 | Carter |
| 2008/0135558 | A1 | 6/2008 | Udodor |
| 2008/0164257 | A1 | 7/2008 | Boll |
| 2008/0199299 | A1 | 8/2008 | Baader |
| 2008/0237249 | A1 | 10/2008 | McGee |
| 2008/0245794 | A1 | 10/2008 | Escobar |
| 2009/0039081 | A1 | 2/2009 | Fort |
| 2009/0084788 | A1 | 4/2009 | Yang |
| 2009/0188933 | A1 | 7/2009 | Daams |
| 2009/0230131 | A1 | 9/2009 | McDuffie |
| 2009/0314779 | A1 | 12/2009 | Lee |
| 2009/0321449 | A1 | 12/2009 | Arthurson |
| 2010/0147865 | A1 | 6/2010 | Yang |
| 2010/0219192 | A1 | 9/2010 | Quan |
| 2011/0017744 | A1 | 1/2011 | Sandhu |
| 2011/0186574 | A1 | 8/2011 | Zhong |
| 2011/0220655 | A1 | 9/2011 | Yang |
| 2011/0272407 | A1 | 11/2011 | Golcheh |
| 2012/0037637 | A1 | 2/2012 | Beyda |
| 2012/0118895 | A1 | 5/2012 | Lin |
| 2012/0126676 | A1 | 5/2012 | Fistonich |
| 2012/0267362 | A1 | 10/2012 | Horowitz |
| 2013/0048641 | A1 | 2/2013 | Romano |
| 2013/0075400 | A1 | 3/2013 | Robinson |
| 2013/0098913 | A1 | 4/2013 | Yang |
| 2013/0105486 | A1 | 5/2013 | Mashburn |
| 2013/0105488 | A1 | 5/2013 | Quan |
| 2013/0134167 | A1 | 5/2013 | Burleson |
| 2013/0206021 | A1 | 8/2013 | Prescott |
| 2013/0341328 | A1 | 12/2013 | Schneider |
| 2014/0084008 | A1 | 3/2014 | Conway |
| 2014/0183193 | A1 | 7/2014 | Hammond |
| 2014/0238993 | A1 | 8/2014 | Andersen |
| 2014/0263347 | A1 | 9/2014 | Ballard |
| 2014/0332537 | A1 | 11/2014 | Goodfield |
| 2015/0021332 | A1 | 1/2015 | Autumn |
| 2015/0122819 | A1 | 5/2015 | Rousso |
| 2015/0259139 | A1 | 9/2015 | Yang |
| 2015/0274417 | A1 | 10/2015 | Feanny |

* cited by examiner 38
97
99
40
48
54
58
260
262
264
266
268
270
272
274
276
278
280
282
284
286

WASTE RECEPTACLE

FIELD

The present application relates to lid covered waste receptacles and, more specifically, to waste receptacles having a foot operated actuator at a lower portion for opening the lid and including a shock absorbing portion to permit a soft close of the lid.

BACKGROUND

Waste receptacles have taken a variety of forms, including receptacles having open tops, removable lids, openable lids, and the like. For example, waste receptacles have included lids whereby the lid may be entirely removed from the receptacle, generally requiring the user to remove the lid with his or her hands. This can be somewhat difficult, especially if trash or other waste is currently being held by the user.

In view of this, other waste receptacles have been developed whereby the lid can be operated, such as by a foot pedal located near a lower end of the waste receptacle. These types of waste receptacles are much more convenient as a user is free to carry and insert waste while being able to open the lid with his or her foot.

However, such foot operated lids oftentimes include features that may interfere with and/or complicate the operation of the lid. For example, oftentimes the linkage may extend into the same general area as the waste and/or bag for receiving the waste. This is oftentimes a result of how the linkage operates from the foot pedal to the lid. In some forms, the foot pedal is rigidly coupled to an elongate linkage whereby the foot pedal and linkage pivots about a pivot point generally underneath the waste storage area. In one form, the pivot point is approximately halfway between the front and rear of the waste receptacle such that the foot pedal may need to move a significant distance to operate the lid. Further, as noted above, the movement of the pedal may interfere with the waste storage area or otherwise cause the volume of the waste storage area to be decreased as a result of the length of travel of the foot pedal and corresponding linkage.

Similarly, the foot pedal and associated linkage may extend through a front wall of the body of the waste receptacle. Again, in situations where the foot pedal pivots about a location generally underneath the waste storage area, the linkage and foot pedal generally travels a significant distance such that a slot or other opening is required in the front wall of the waste receptacle. This may add an undesirable appearance to the body of the waste receptacle, can complicate manufacturing and assembly, and cause other issues in the operation of the waste receptacle.

Furthermore, foot operated lids may also be susceptible to the lid slamming shut as the foot pedal is released and the lid moves towards the closed position. In this regard, some have incorporated dampers that are positioned on the body near the lid. These dampers may help provide a soft close functionality to the lid. However, these dampers may not offer much, if any, dampening to the remainder of the linkage assembly from the foot pedal to the lid. A damper connected to the body may also not provide sufficient dampening force to the foot pedal. In this regard, the foot pedal may move very quickly when closing, potentially causing damage to the body of the waste receptacle and potentially causing injury or otherwise undesirable feedback to the user's foot during operation if the linkage and foot actuator were to move rapidly towards the closed position.

The lid may also be difficult to maintain in the open position, such as when waste and/or the garbage bag is being removed from the waste receptacle. In some forms, the user may be required to maintain pressure on the foot pedal to keep the lid open. In other forms, some waste receptacles include a lock or tab on the body that can interact with the lid to prevent the lid from moving to the closed position. However, the lock may be cumbersome to operate, requiring one hand to fully open the lid and another hand to move the lock to the locked position.

SUMMARY

A waste receptacle is provided herein having a linkage assembly extending from a foot operated actuator near a lower end of the waste receptacle to the lid at an upper end of the waste receptacle. In accordance with one form, the foot operated actuator may be configured to pivot about a pivot point internal to the waste receptacle body such that the foot operated actuator and corresponding linkage does not penetrate or otherwise require a slot or opening in the body of the waste receptacle for operation.

In one form, the linkage assembly includes a shock absorbing portion between a first linkage arm and a second linkage arm. According to one form, the shock absorbing portion includes at least one of a damper and a spring. Further, the shock absorbing portion may be configured such that it is positioned between and permits relative movement between the first and second linkage arms. In one form, the first and second linkage arms are indirectly coupled to one another such that a third linkage arm is positioned intermediate the first and second linkage arms. In this form, the shock absorbing portion may be directly coupled to and between the second and third linkage arms.

In accordance with one form, the shock absorbing portion is not fixed relative to the waste receptacle body. Instead, the shock absorbing portion is fixed to portions of the linkage assembly such that the shock absorbing portion is movable along with the linkage assembly.

According to one form, the linkage assembly connects the foot operated actuator to the lid via a series of linkage arms and connections. The linkage assembly can include a first linkage arm operably coupled to the actuator, a second linkage arm operably coupled to the lid, a third linkage arm positioned intermediate the first and second linkage arms, and a shock absorbing portion positioned between and coupled to the second and third linkage arms. The lid, actuator, first and second linkage arms, and the shock absorbing portion are each movable between a first position where the lid is closed and a second position where the lid is at least partially open by pivoting at least a portion of the lid from the body to expose the opening. The shock absorbing portion is expandable between the second and third arms so as to dampen relative motion between the second and third linkage arms.

In one form, the second and third linkage arms extend and are movable in a generally vertical position with the shock absorbing portion coupled to and positioned therebetween. The second and third linkage arms may also be configured with at least one of the linkage arms having a channel shape with the other of the linkage arms slidably positioned in the channel. Further, the first linkage arm extends and moves in a generally horizontal direction.

In accordance with one form, the linkage assembly includes a first linkage arm operably coupled to the actuator on the interior of the body and movable in a generally horizontal direction, a cam bracket coupled to an end of the first linkage arm opposite the actuator, and a second linkage arm having a first end coupled to the cam bracket and a second end opposite the first arm coupled to the lid. The second linkage arm is movable in a generally vertical direction. The lid, actuator, first linkage arm, cam bracket, and second linkage arm, are each movable between a first position where the lid is closed and a second position where the lid is at least partially open by pivoting at least a portion of the lid from the body to expose the opening.

In one form, the lid includes a cam bracket coupled thereto with the cam bracket having an arcuate slot permitting the lid to pivot beyond the movement of the actuator such that the lid can remain in an open position without further force being applied to the actuator.

According to one form, the waste receptacle further includes a second shock absorbing portion extending between the body and a portion of the actuator on an interior portion of the body. The second shock absorbing portion can include one or more dampers and/or springs to dampen the return of the foot operated actuator as it moves towards the closed position. In this form, movement of the foot pedal during closing can be more directly controlled.

These and other aspects may be understood more readily from the following description and the appended drawings.

DETAILED DESCRIPTION

Figure 2:
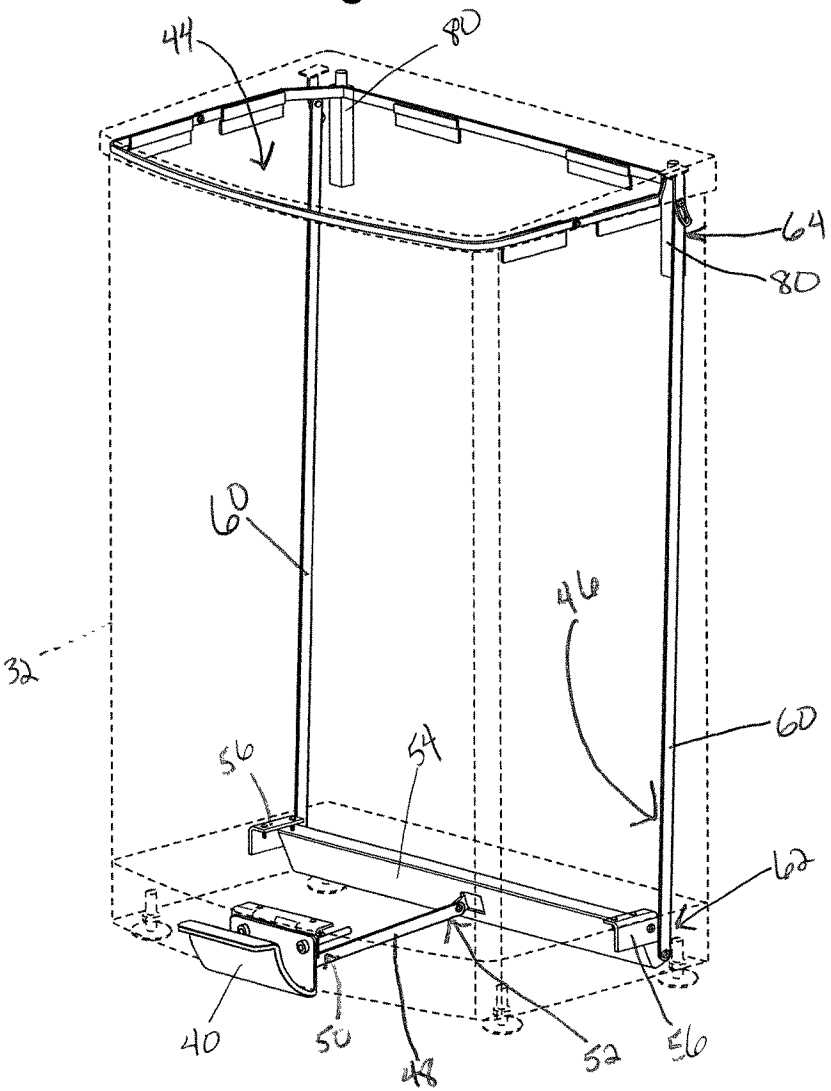
FIG. 2 is a perspective view of the internal linkages for opening the waste receptacle of FIG. 1.
Figure 1:
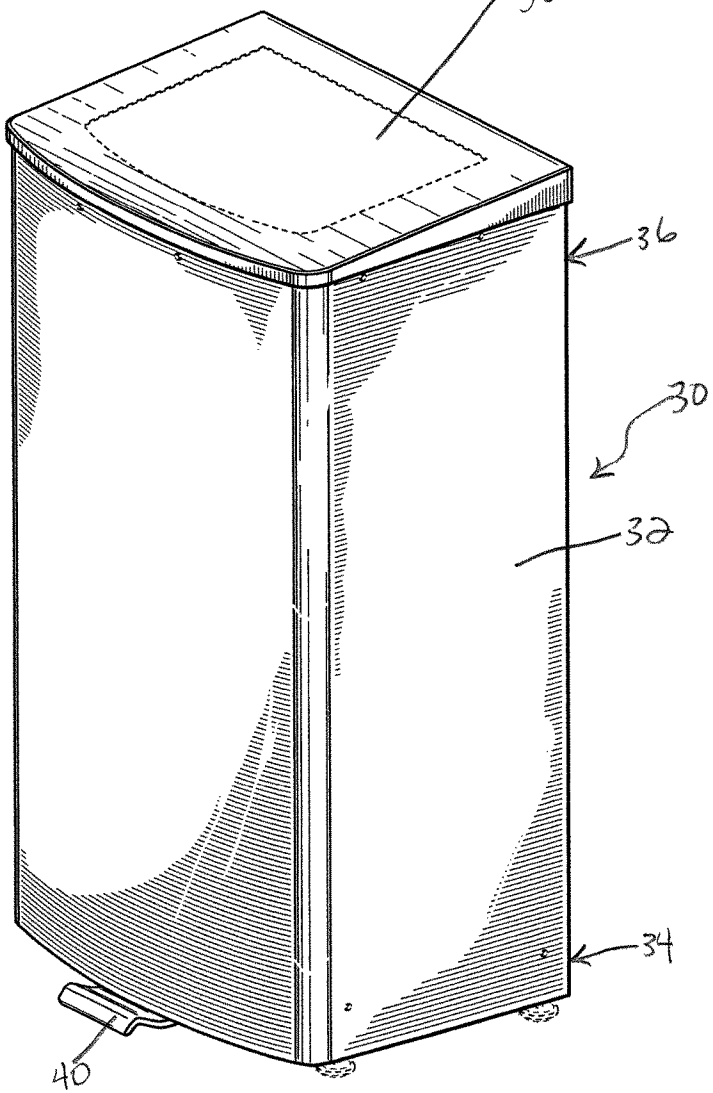
FIG. 1 is a perspective view of one embodiment of a waste receptacle.
Figure 4:
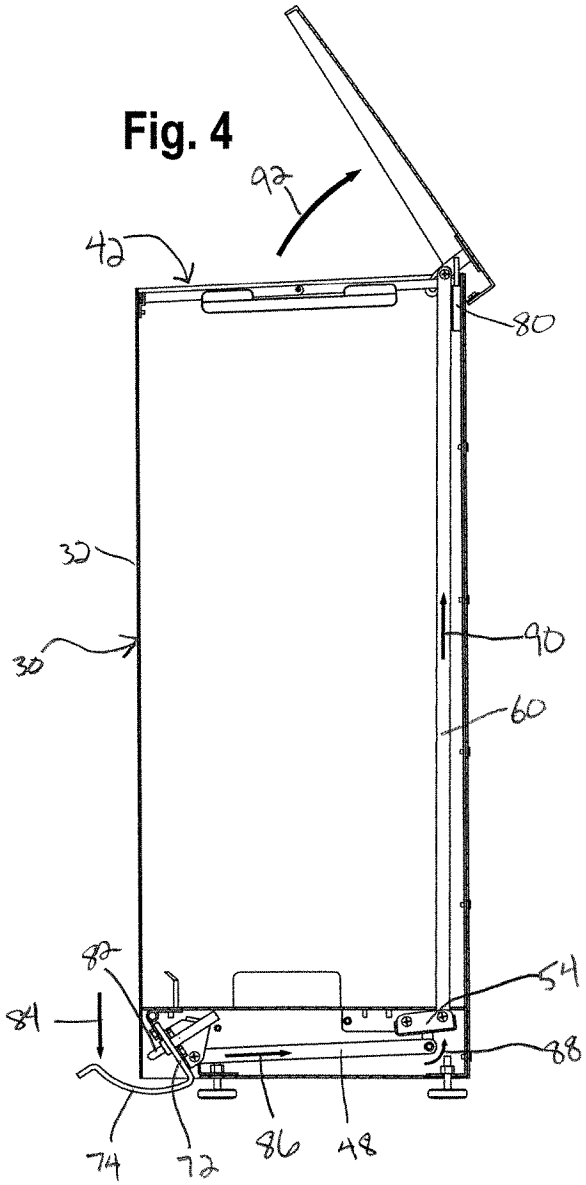
FIG. 4 is a cross-sectional view of the waste receptacle of FIG. 1 as the lid is moved to the open position.

Referring to FIGS. 1 and 2, one form of a waste receptacle 30 is shown. The waste receptacle 30 includes a body 32 having an upper end 34 and a lower end 36. Further, the waste receptacle 30 includes a lid 38 and a foot operated actuator 40, such as in the form of a foot pedal. As shown in FIG. 1, the actuator 40 extends to a position on an exterior side of the waste receptacle 30. Waste can be inserted into the waste receptacle 30 via an opening 42 when the lid 38 pivots away from at least a portion of the body 32 to thereby retain the waste on an interior portion 44 of the body.

The lid 38 is operably coupled to the actuator 40 via a linkage assembly 46. The linkage assembly 46 can include a variety of different components, such as linkage arms, cam brackets, various connectors, other brackets, and other related structures. As shown in the embodiment in FIG. 2, the linkage assembly 46 includes a first linkage arm 48 having a first end 50 coupled to the actuator 40 and a second end 52 coupled to a cam bracket 54. In one form, the cam bracket 54 can be coupled to a portion of the body 32. In this regard, the cam bracket 54 can include one or more mounting brackets 56 that can be coupled to one or more of the body 32 and a lower wall 58. However, it should be appreciated that it is not necessary for the waste receptacle 30 to include a lower wall 58 such that the cam bracket 54 can be mounted with any appropriate structure that permits pivotal movement of the cam bracket 54, as will be explained in more detail below with regards to the movement of the linkage assembly 46.

The cam bracket 54 is also connected to other portions of the linkage assembly 46. For example, the cam bracket 54 may be coupled to one or more second linkage arms 60. As shown in FIG. 2, the cam bracket 54 may be coupled to two, second linkage arms 60 at the opposite ends of the cam bracket 54. In this regard, the use of two, second linkage arms 60 may help provide balanced movement of the lid 38 as it is moved between the opened and closed positions. More specifically, first ends 62 of the second linkage arms 60 are coupled to the cam bracket 54 while opposite, second ends 64 of the second linkage arms may be coupled to the lid 38. In one form, the second ends 64 may include a protrusion 66, such as in the form of pins, bolts, and the like that can be positioned in a slot 68 extending from a cam bracket 70 on the lid 38. The slot 68 can have a generally arcuate shape to permit the lid to be retained in an open position, as will be discussed in more detail below.

Figure 3:
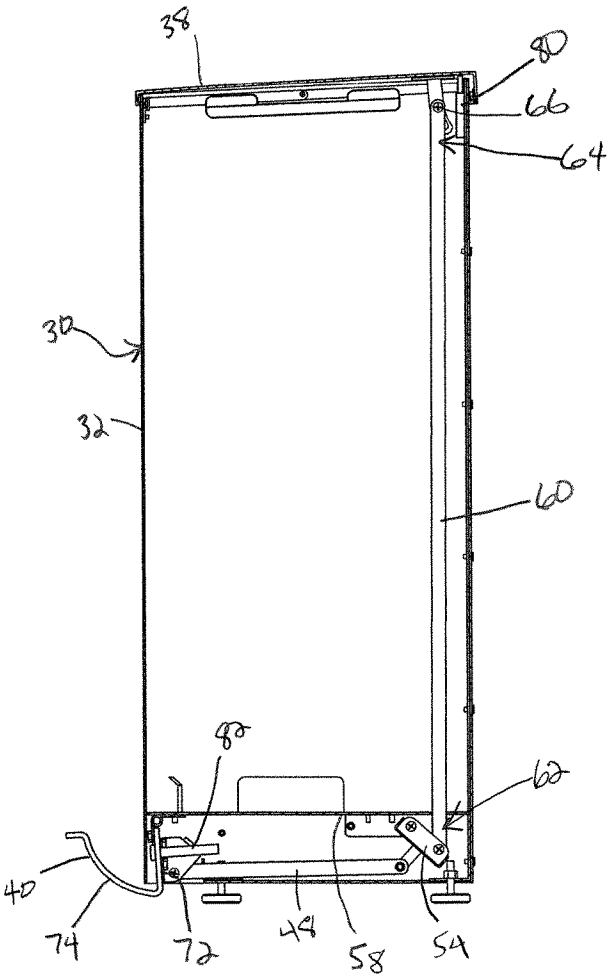
FIG. 3 is a cross-sectional view of the waste receptacle of FIG. 1 with the lid in the closed position.

As shown in FIG. 3, the actuator 40 can include a first portion 72 generally positioned on an interior portion 44 of the body 32 and a second portion 74 positioned generally on an exterior portion of the body 32 when the actuator 40 and lid 38 are in the closed position. In one form, the actuator 40 is coupled to the body 32 such as to one or more of the interior portion 44 of the body 32 and the lower wall 58. In this form, the actuator 40 generally pivots about a point interior to the body 32.

The waste receptacle 30 can also include one more shock absorbing portions located at various areas on the waste receptacle 30. For example, the waste receptacle 30 can include a shock absorbing portion 80 positioned adjacent the lid 38. In this form, the shock absorbing portion 80 may be coupled to the body 32 and provide a dampening function as the lid 38 moves between the open and closed positions. A shock absorbing portion 82 may also be positioned adjacent the actuator 40 to provide a dampening function at the actuator. It should be appreciated that a variety of different structures may be utilized to provide shock absorbing functionality including, but not limited to dampers, springs, shocks, combinations thereof and the like. For example, a shock absorbing portion may include a damper and spring in combination with one another. Further, it should be appreciated that multiple forms of these structures may be provided in the respective locations. For example, multiple dampers may be used at the actuator 40 to provide sufficient dampening function. Further, the shock absorbing portions may provide added force to help lift and or move different aspects of the waste receptacle, depending on the location. For example, a spring and damper may be utilized adjacent the lid 38 such that the combination may provide added force as the lid extends towards the open position.

The movement of the lid 38 between the open and closed positions will now be described in more detail along with the respective movements of the components of the linkage assembly 46 and other associated structures. The lid 38, actuator 40, first linkage arm 48, cam bracket 54, and second linkage arms 60, are each movable between a first position where the lid is closed and a second position where the lid is at least partially open by pivoting at least a portion of the lid from the body to expose the opening.

Figure 6:
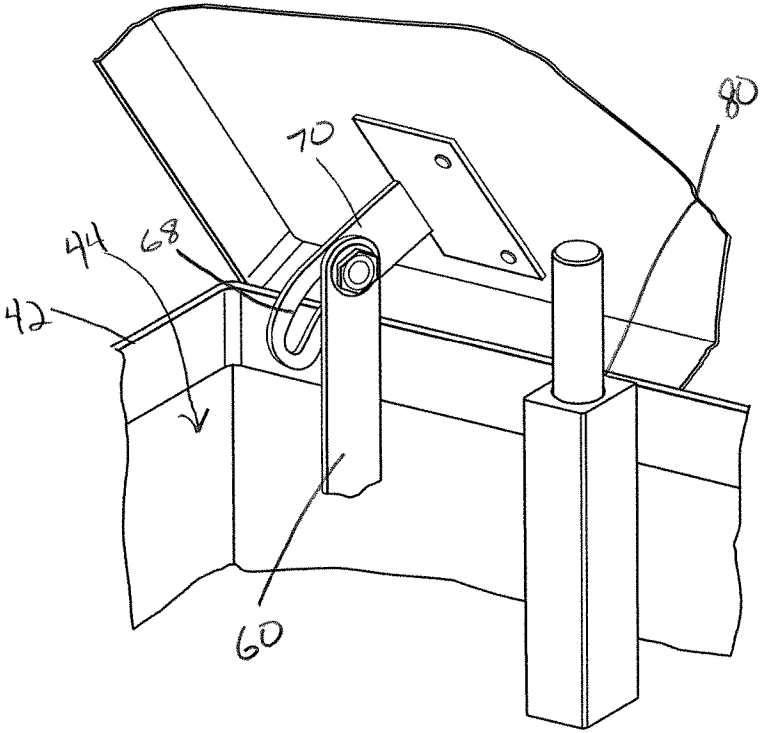
FIG. 6 is an enlarged view of a portion of a lid of a waste receptacle.
Figure 5:
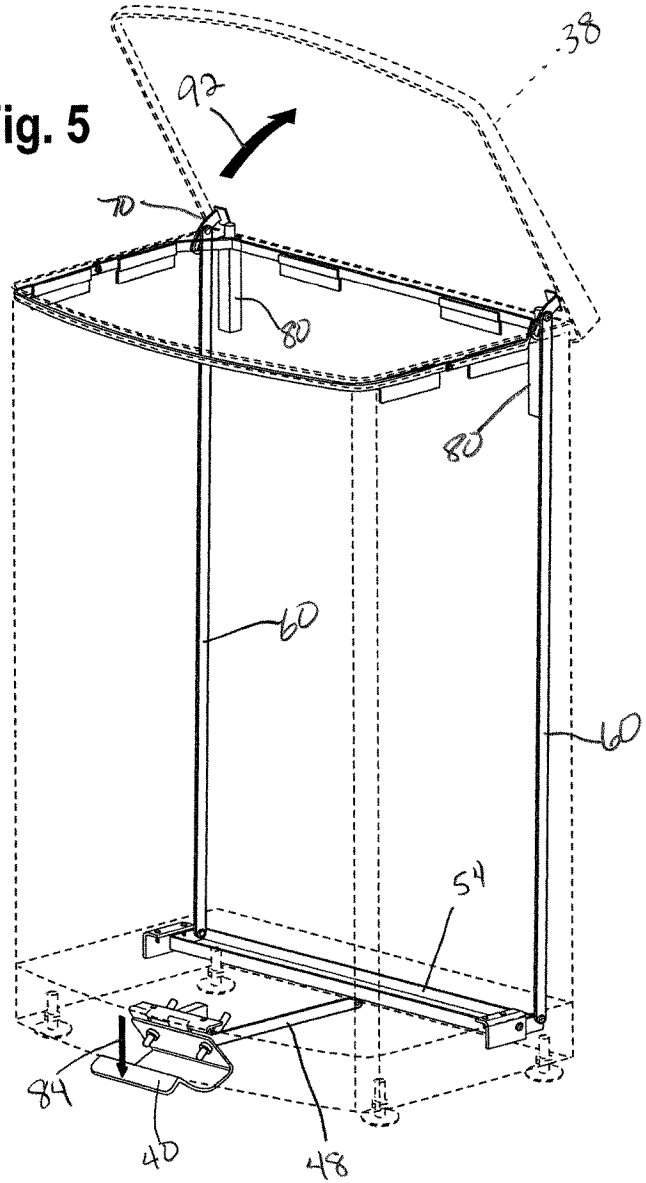
FIG. 5 is a perspective view of the linkages of the waste receptacle of FIG. 1 as it is moved to an open position.

As shown in FIG. 3, the lid 38 is in the closed position with the actuator 40 pivoted to an upward position. When it is desired to open the lid 38, the actuator can be pressed downwardly, as indicated by arrow 84, causing the actuator to pivot. This movement in turn causes the first linkage arm 48 to move in a generally horizontal direction, as shown by arrow 86. As the linkage arm 48 moves in the direction of arrow 86, the cam bracket 54 pivots generally in a direction shown by arrow 88. This, in turn, causes the second linkage arms 60 to move in a generally vertical direction, as indicated by arrow 90. The second linkage arms 60 then push against an upper portion of slot 68, causing the lid 38 to move towards the open position, as indicated by arrow 92. An enlarged view of the interaction of the second linkage arms 60 and the slot 68 is shown in FIG. 6. As shown in this figure, as the lid 38 moves to the open position, the shock absorbing portion 80 also extends upwardly. In one form, at some point, the lid 38 pivots sufficiently that the lid 38 may no longer be in contact with the shock absorbing portion 80.

Figure 8:
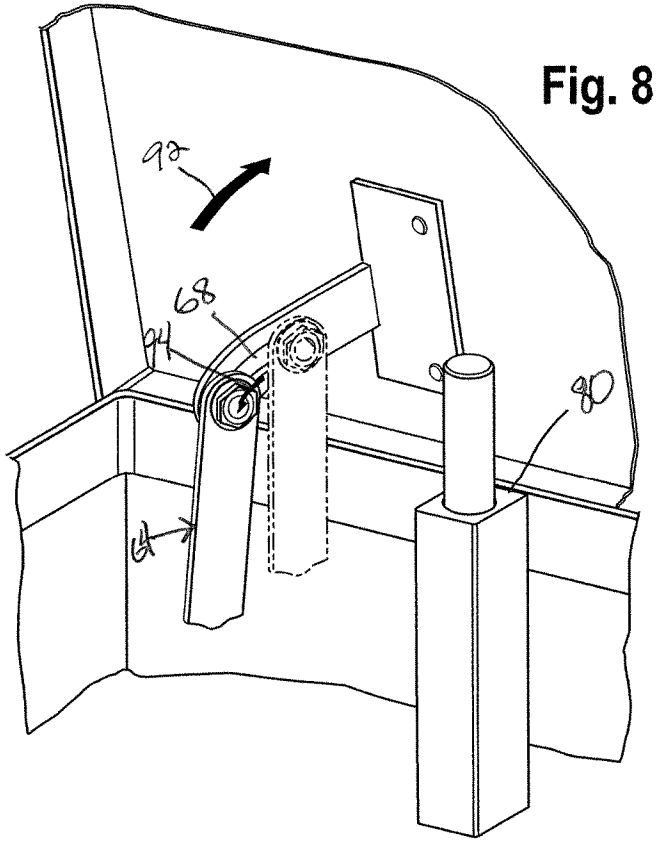
FIG. 8 is an enlarged view of a portion of a lid as it is moved to a fully open position.
Figure 7:
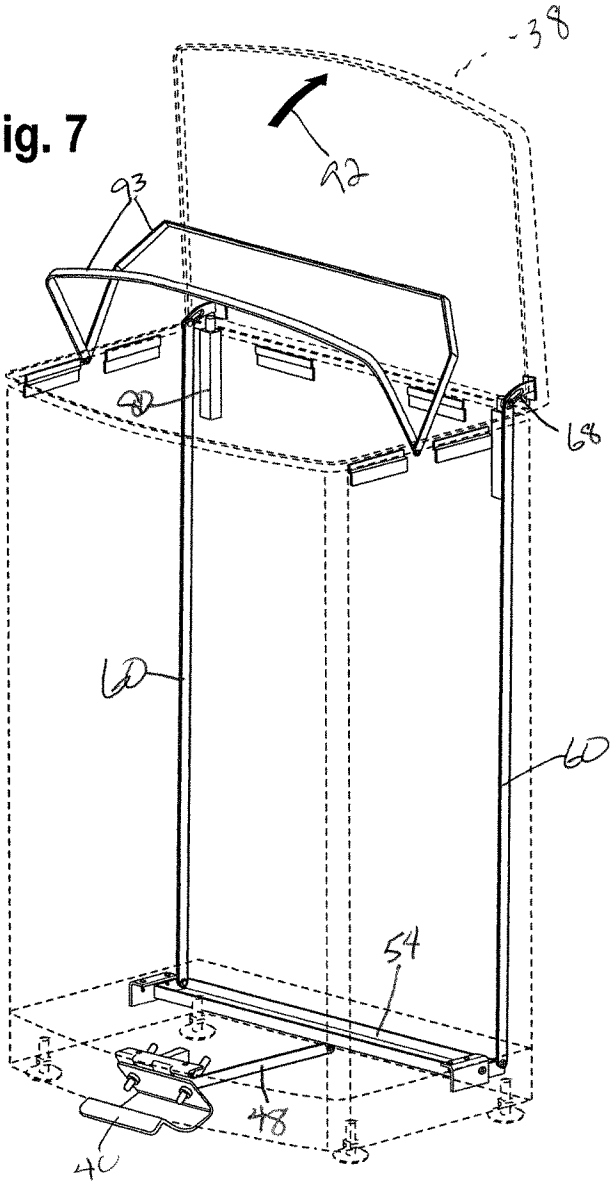
FIG. 7 is a perspective view of a waste receptacle as the lid is moved to a fully open position.
Figure 10:
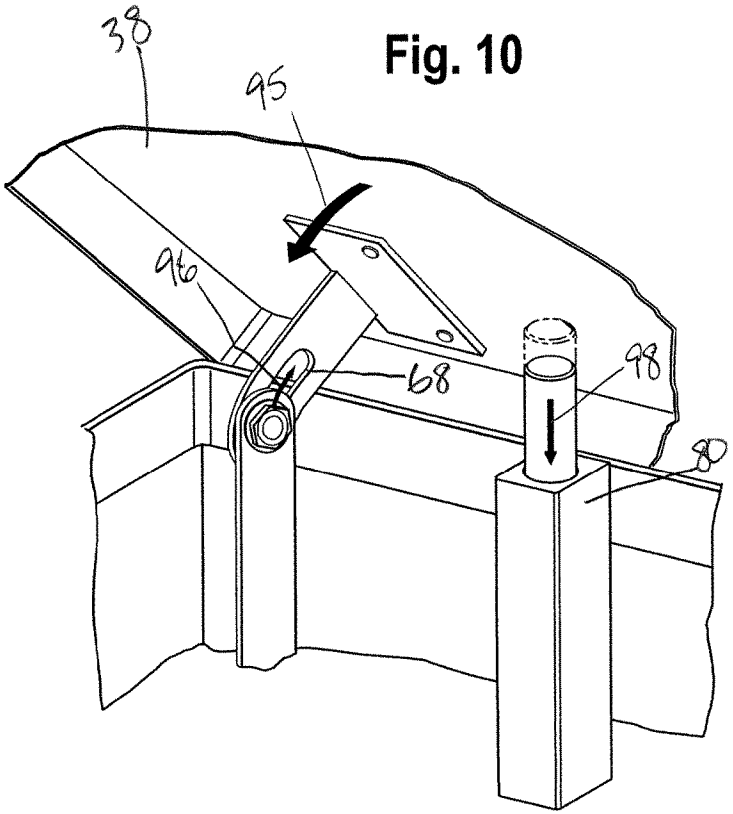
FIG. 10 is an enlarged view of a portion of a lid as it is moved towards a closed position.
Figure 9:
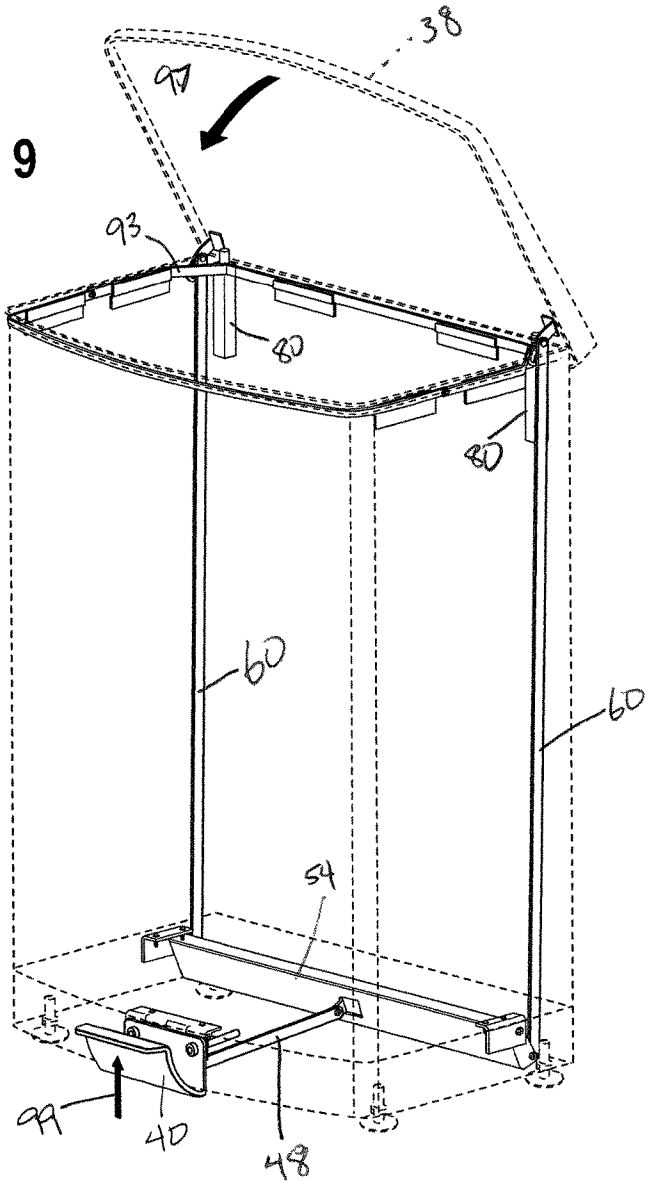
FIG. 9 is a perspective view of a waste receptacle as it is moved towards a closed position.
Figure 13:
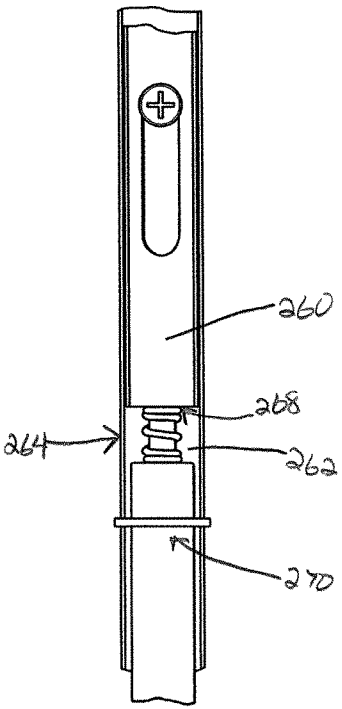
FIG. 13 is partial view of a shock absorbing portion of a linkage assembly moving towards and open position.

The lid 38 may also be pivoted further beyond the movement of the linkage assembly 46. In other words, the linkage assembly 46 may cause the lid 38 to pivot to a certain position whereby the lid 38 may then be grasped by a user and pivoted even further beyond the limit of the linkage assembly 46. For example, as shown in FIGS. 7 and 8, the lid 38 may be further pivoted, as shown by arrow 92. The lid 38 is permitted to pivot further beyond the movement of the linkage assembly as a result of the slot 68. In this form, the connection between the upper portion 64 of the second linkage arm 60 slides from an upper end of the slot 68 towards a lower end of the slot 68, as shown by arrow 94. When open, a garbage bag (not shown) or other waste, may be removed from retainers 93.

The lid 38 may be moved from the open position towards the closed position in generally the opposite movements described above. The lid 38 may be moved by a user from a fully extended position, as shown in FIGS. 7 and 8, in a direction indicated by arrow 95. This movement causes the connection between the second linkage arms 60 and the lid 38 to slide in the slot 68 from a lower end thereof towards an upper end thereof, as indicated by arrow 96. From there, the lid 38 may pivot further downwardly as shown by arrow 97. The shock absorbing portion 80 may also be moved from an extended position towards a compressed position, as indicated by arrow 98, at some point during the closing movement. Similarly, shock absorbing portion 82 may also move from an extended position towards a compressed position, if included in the waste receptacle. As the linkage assembly moves from the open position towards the closed position, the linkage arms 48 and 60, as well as cam bracket 54, move in the opposite directions as when moving towards the open position. This, in turn, causes the actuator 40 to pivot generally upwardly, as indicated by arrow 99.

A further form of a waste receptacle 230 is shown in FIGS. 11-17. Waste receptacle 230 generally includes many similar features as those described above and therefore uses similar reference numbers. Waste receptacle 230 can include the same features as those described for waste receptacle 30 and may also include further features, such as those described below.

In one form, the waste receptacle 230 includes a linkage assembly 246 including the first linkage arm 48 and the cam bracket 54 but adding additional linkages and shock absorbing portions. More specifically, the linkage assembly 246 includes a second linkage arm 260 and adds a third linkage arm 262 between the first linkage arm 48 and the second linkage arm 260. It should be appreciated that the linkage assembly 246 may include two of each of the second and third linkage arms 260,262, such that they interact with ends of the lid, similar to waste receptacle 30 and similar to shown in FIG. 2. In this regard, the combination of the second and third linkage arms 260,262 may be thought of as a set, with one waste receptacle 230 having two sets of these arms per waste receptacle 230.

Further, the linkage assembly 246 includes a shock absorbing portion 264 between the second and third linkage arms 260, 262. In this regard, a shock absorbing portion 246 may be included with each set of second and third linkage arms 260,262. The shock absorbing portion 264 may have a first portion 268 coupled to the second linkage arm 260 and a second portion 270 coupled to the third linkage arm 262. In this regard, the first and second portions 268,270 may be movable relative to one another, thereby permitting the second and third linkage arms 260,262 to move relative to one another. The shock absorbing portion 264 may take a variety of forms, as discussed above with respect to shock absorbing portion 80. In one form, the shock absorbing portion 264 may take the form of a damper and a spring, though other forms are also contemplated.

Further, it should be noted that in waste receptacle 230, it may not be necessary to include shock absorbing portion 80, but instead include shock absorbing portion 264. In this form, the shock absorbing portion 264 may provide desired dampening functionality further from the lid 38 and between one or more linkage arms, such as described above.

Figures 14, 15, 16, 17:
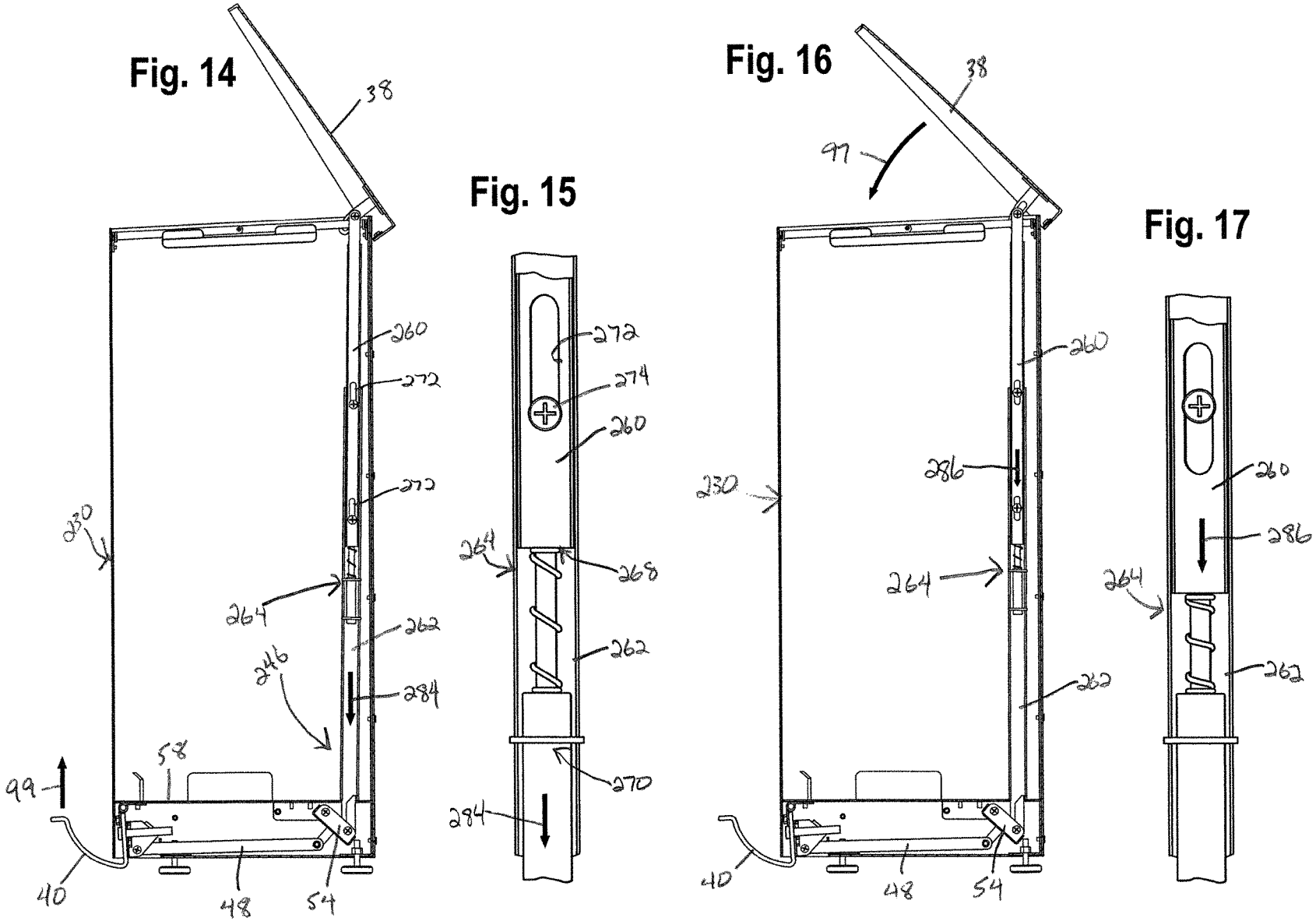
FIG. 14 is a cross-sectional view of the embodiment of FIG. 11 moving towards a closed position.
FIG. 15 is a partial view of a shock absorbing portion of a linkage assembly moving towards a closed position.
FIG. 16 is a cross-sectional view of the embodiment of FIG. 14 moving further towards a closed position.
FIG. 17 is a partial view of a shock absorbing portion of a linkage assembly moving further towards a closed position.

The second and third linkage arms 260,262 may also be configured in a certain manner so as to permit relative movement therebetween and also maintain desired structural integrity of the linkage assembly 246. For example, in one form, at least one of the second and third linkage arms may be in the form of a channel. In this regard, the linkage arm may have a generally U-shaped cross-section. The other of the second and third linkage arms 260,262 may have a similar, but smaller cross-sectional shape so that one of the linkage arms rides within the other of the linkage arms. For example, as shown in FIG. 14, the third linkage arm 262 has a generally U-shaped cross-section while the second linkage arm 260 has a similar, but smaller U-shaped cross-section. In this form, the second linkage arm 260 may be at least partially positioned within the cross-section of the third linkage arm 262.

To further assist in maintaining the orientation of the second and third linkage arms 260,262, a variety of slots and corresponding protrusions may be used to help guide the movement of the arms 260,262. The slots and protrusions may be positioned on either one of the second and third linkage arms 260,262. For example, as shown in FIG. 14, two slots 272 are positioned on the second linkage arm 260 while two protrusions 272, such as in the form of screws or bolts, are positioned on and extend from the third linkage arm 262. During assembly, the second linkage arm 260 may be slid into the third linkage arm 262 so as to align the slots 272 with openings (not shown) in the third linkage arm 262 for receiving the screws 274. In this form, the heads of the screws 274 are larger than the width of the slots thereby permitting relative sliding movement without permitting the second and third linkage arms 260,262 from becoming completely detached from one another.

The movement of the linkage assembly 246 will now be discussed in more detail. Similar to linkage assembly 46, linkage assembly 246 will move as the actuator 40 is pivoted in a direction shown by arrow 84. This, in turn, causes the first linkage arm 48 to move in a generally horizontal direction shown by arrow 48 and cam bracket 54 to pivot in a direction shown by arrow 88. The pivoting of the cam bracket 54 causes a vertical movement in linkage assembly 246, similar to linkage assembly 46. However, in linkage assembly 246, the third linkage arm 262 is moved in a generally vertical direction, as shown by arrow 280, which causes the second linkage arm 260 to also move in a generally vertical direction, as shown by arrow 282. Movement of the second and third linkage arms 260,262 then causes the lid to pivot towards the open position, as shown by arrow 92.

Movement from the open position to the closed position is generally the reverse. As shown in FIGS. 14-17, as the actuator 40 is released, it pivots in a direction indicated by arrow 99. This, in turn, permits the third linkage arm 262 to move downwardly in a vertical direction indicated by arrow 284. This movement may start the downward movement of the second linkage arm 260, depending on if the shock absorbing portion 264 is already fully extended. At some point, such as towards the bottom of the downward movement of the third linkage arm 260, the second linkage arm 260 will continue to move downwardly, as shown by arrow 286, because of the shock absorbing portion 264. This downward movement of the second linkage arm 260 will continue until the shock absorbing portion 264 is compressed. This functions as a soft close type feature, permitting the second linkage arm 260 to continue moving and/or move more rapidly than the third linkage arm 262.

From this, it should be appreciated that the shock absorbing portion 264 is expandable between the second and third arms 260,262 so as to dampen relative motion between the second and third arms 260,262. Further, as found in linkage assembly 246, the shock absorbing portion 264 is not fixed in position relative to the body 232 as it is instead coupled to the second and third linkage arms 260,262. In this form, the shock absorbing portion can reduce jarring and other shocks to the linkage assembly.

Figure 12:
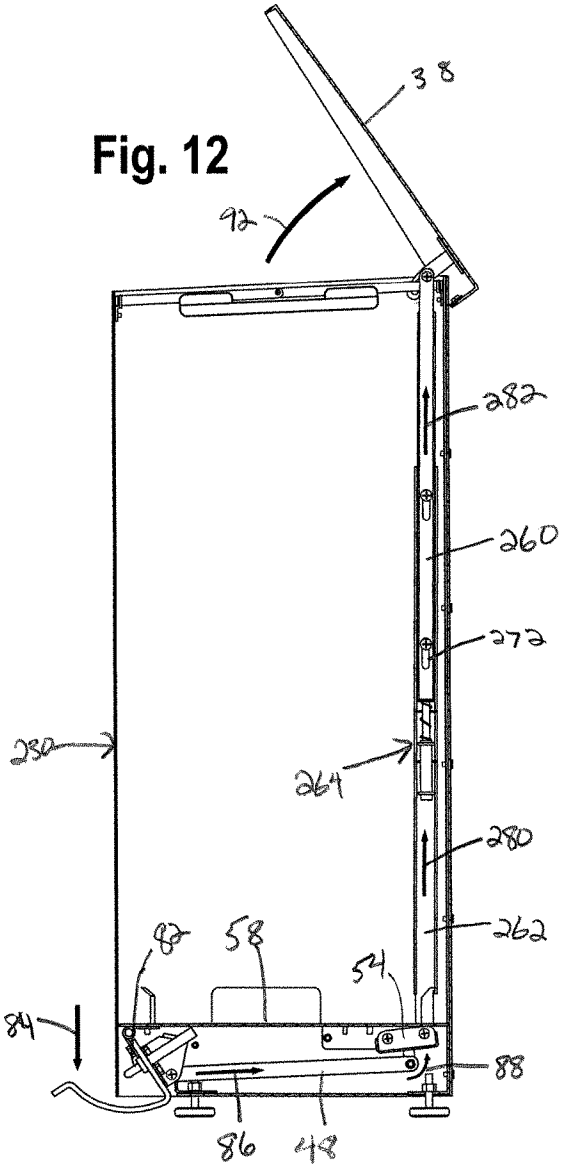
FIG. 12 is a cross-sectional view of the embodiment of FIG. 11 moving towards an open position.
Figure 11:
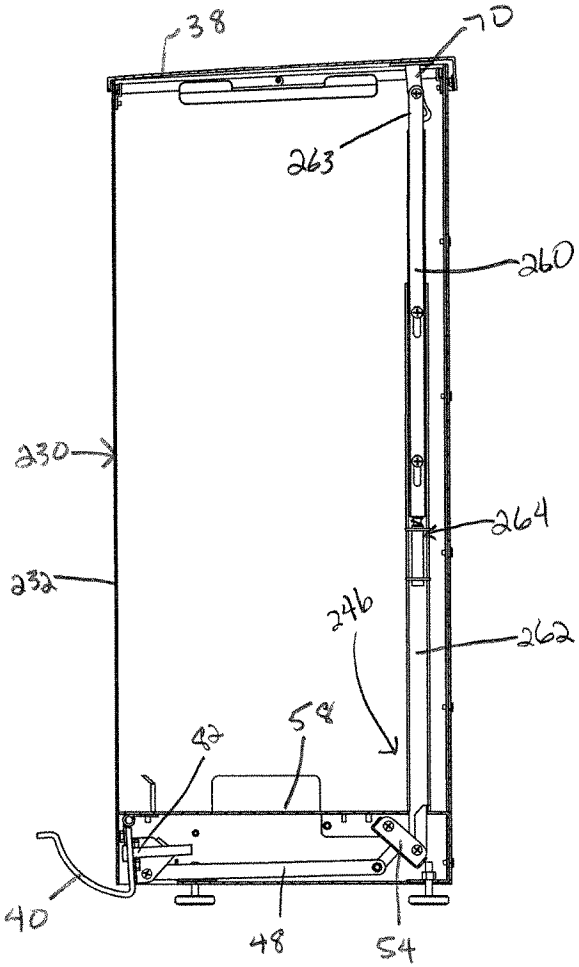
FIG. 11 is a cross-sectional view of another embodiment of a waste receptacle.

It should also be appreciated that at some point, such as towards the open position, the shock absorbing portion 264 may fully extend. This is shown in FIG. 12. In other forms, the shock absorbing portion 264 may not fully extend until the force at the actuator is lowered, such as just as the lid begins moving from the open position towards the closed position.

A further embodiment of a waste receptacle 330 is shown in FIGS. 18-21. Waste receptacle 330 generally includes many similar features as those described above and therefore uses similar reference numbers. Waste receptacle 330 can include the same features as those described for waste receptacles 30,230 and may also include further features, such as those described below. Further, it should be appreciated that the features described for each of waste receptacles 30,230,330 may be interchanged and/or combined such that the features are not necessarily restricted to a single embodiment.

In waste receptacle 330, a portion of the linkage arms may be modified from those described previously. In this form, second linkage arm 360 may include a generally U-shaped cross-section that extends nearly the entire length towards the lid 38. This difference can be best seen comparing the structure shown at end 363 in FIG. 18, with end 263 in FIG. 11. The use of the generally U-shaped cross-section may provide further rigidity to the second linkage arm 360.

Figure 18:
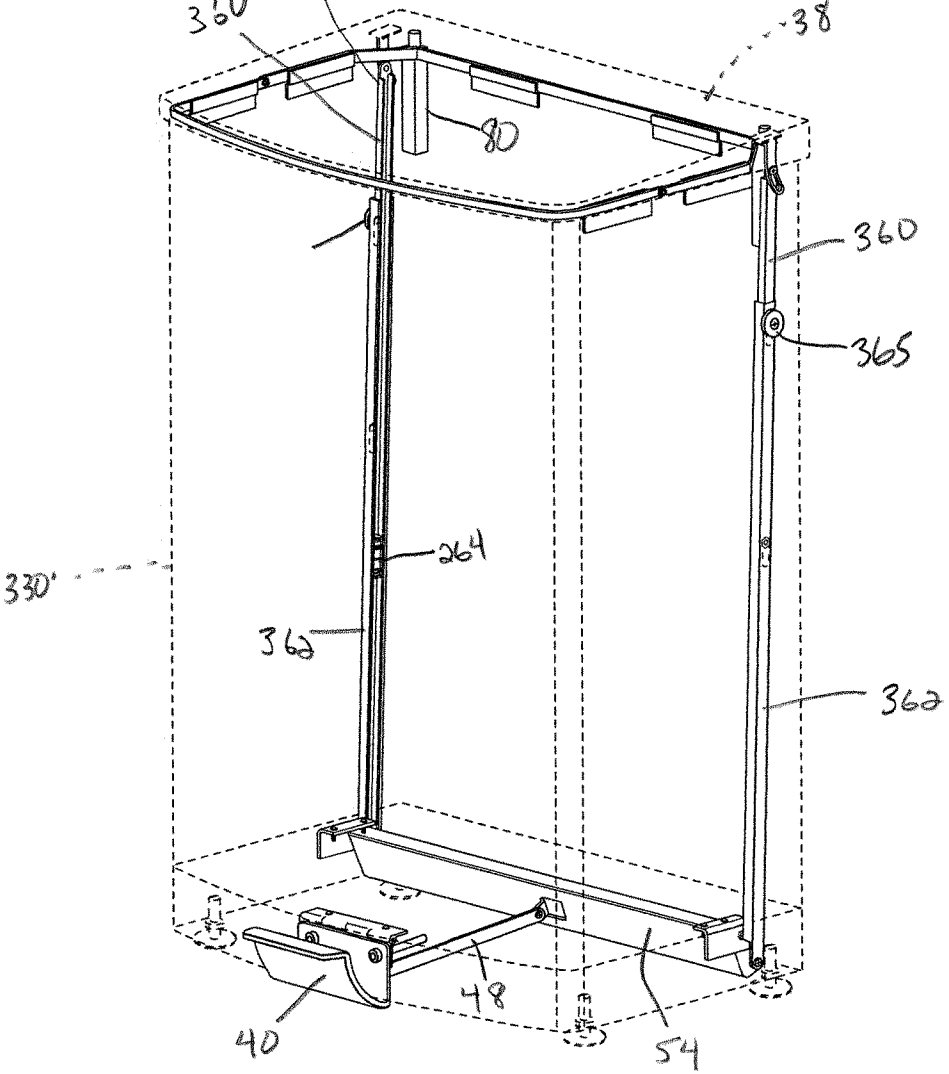
FIG. 18 is a perspective view of another embodiment of a waste receptacle.
Figure 20:
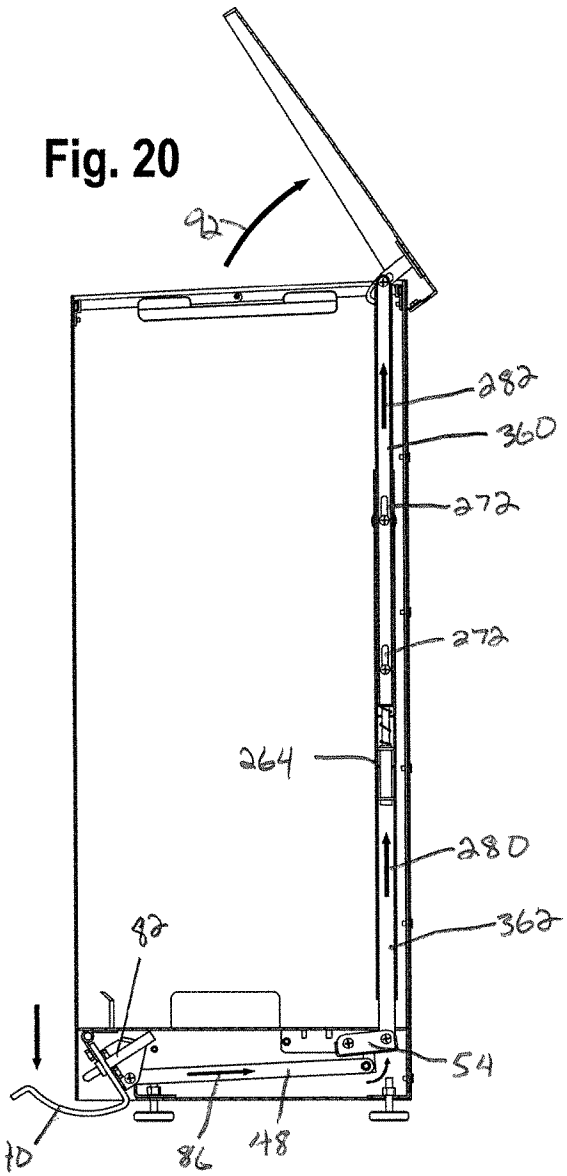
FIG. 20 is a cross-sectional view of the waste receptacle of FIG. 18 moving towards an open position.
Figure 19:
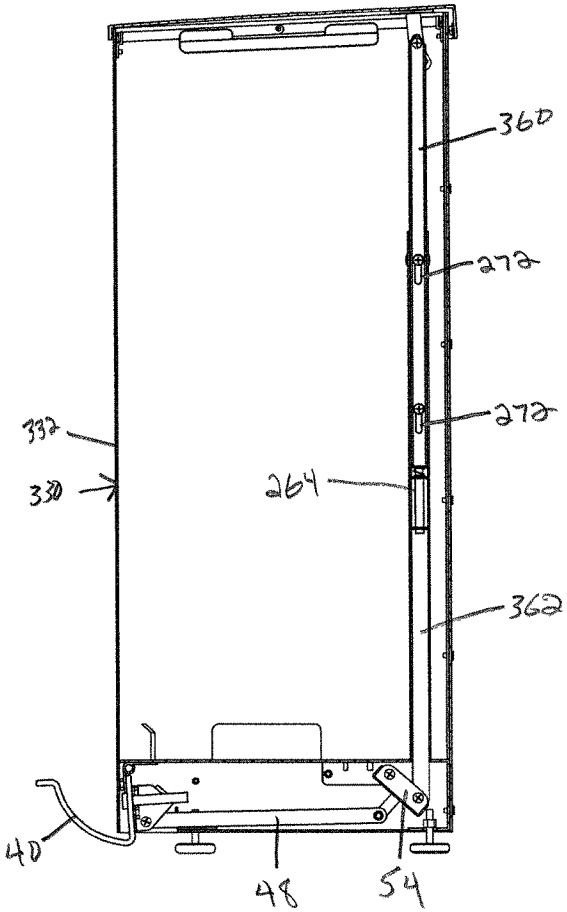
FIG. 19 is a cross-sectional view of the waste receptacle of FIG. 18.

Third linkage arm 362 may also be modified from previous forms. As shown in FIG. 18, the third linkage arm 362 may include a wheel 365. The wheel 365 may be rotatable and help prevent binding between the third linkage arm 362 and the body 332 and/or any waste or other containers (not shown) that may be placed in the waste receptacle. The third linkage arm 362 moves as the lid is moved between the closed and open positions and the wheel 365 may help prevent friction during this movement. It should also be appreciated that multiple wheels may be positioned on the third linkage arm 362, one or more wheels may be positioned on the second linkage arm 360, and/or a combination of these features.

Figure 21:
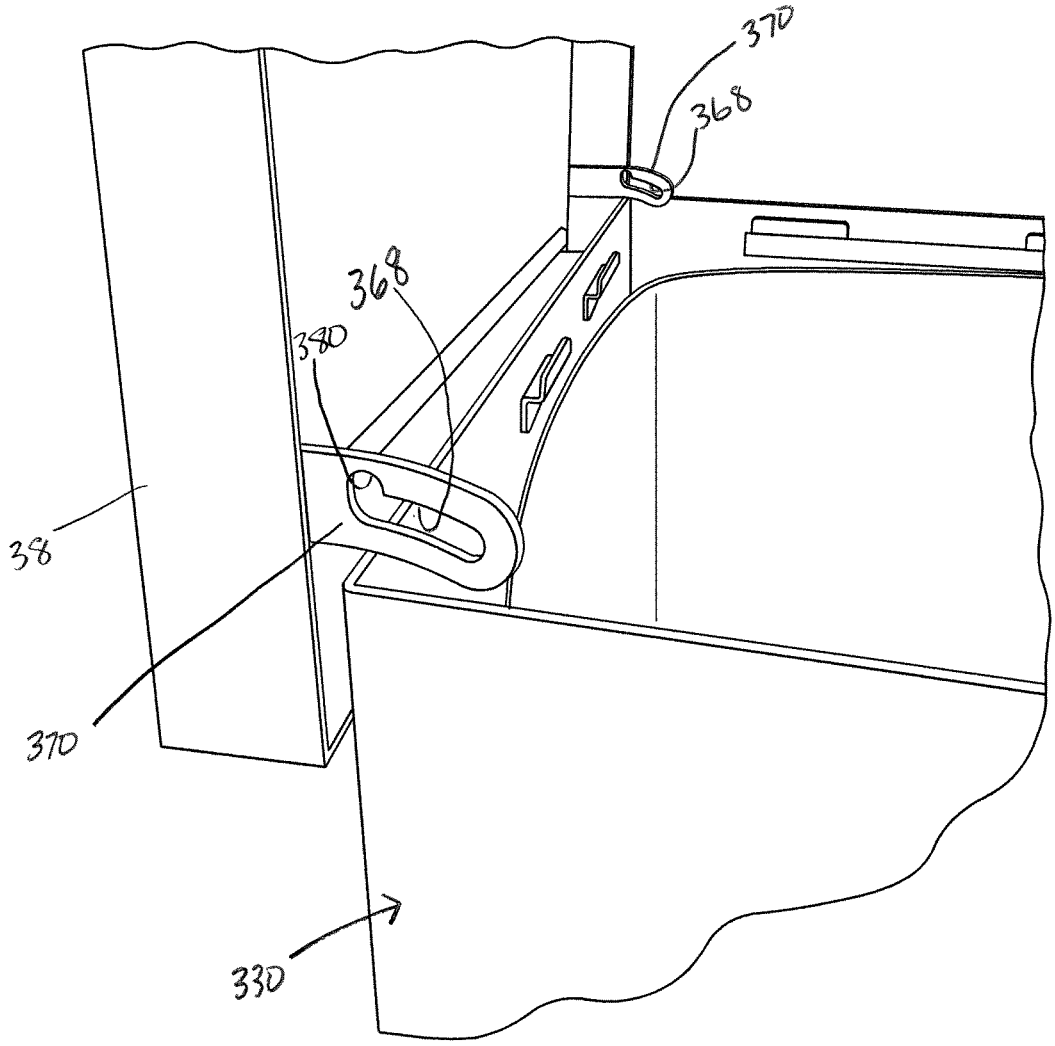
FIG. 21 is an enlarged view of a portion of a lid.

As shown in FIG. 21, the lid 38 may also be modified with a different cam bracket 370. This cam bracket 370 may include a slot 368, similar to slot 68, but further including an extension 380. This extension may help maintain the lid 330 in the fully open position. In one form, the extension 380 is positioned such that it extends generally upwardly from the slot 368 when the lid is moved to the fully open position. Similar to many of the other modifications, this modification found in slot 368 may also be incorporated into the other waste receptacles 30,230.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. Further, different portions of each embodiment may be used in other embodiments. The actual scope of the protection sought is intended to be defined in the following claims when viewed in their proper perspective based on the prior art.

What is claimed is:

1. A waste receptacle assembly comprising:

a body having an upper end and a lower end, the upper end including an opening for inserting waste into the receptacle;

a lid for selectively covering at least a portion of the opening, the lid pivotably movable with respect to the body;

an actuator positioned exterior to the body adjacent the lower end;

a first linkage arm operably coupled to the actuator;

a second linkage arm operably coupled to the lid; and a shock absorbing portion positioned between the first and second linkage arms and not being in a fixed position relative to the body, the lid, actuator, first and second linkage arms, and the shock absorbing portion each movable between a first position where the lid is closed and a second position where the lid is at least partially open by pivoting at least a portion of the lid from the body to expose the opening.

2. The waste receptacle of claim 1 further comprising a third linkage arm and a cam bracket positioned intermediate the first and second linkage arms such that the first and second linkage arms are indirectly coupled to one another via the cam bracket and the third linkage arm.

3. The waste receptacle of claim 2 wherein the second and third linkage arms extend in a generally vertical position with the shock absorbing portion coupled to and positioned therebetween.

4. The waste receptacle of claim 2 wherein at least a portion of one of the second and third linkage arms is positioned within a channel of the other of the second and third linkage arms such that the second and third linkage arms are slidable relative to one another.

5. The waste receptacle of claim 2 wherein at least one of the first and second arms includes a rotatable wheel attached thereto to decrease binding between the body and the respective linkage arm.

6. The waste receptacle of claim 1 further comprising a cam bracket coupled to the lid, the cam bracket having an arcuate slot permitting the lid to pivot beyond the movement of the actuator such that the lid can remain in an open position.

7. The waste receptacle of claim 1 wherein the shock absorbing portion includes at least one of a spring and a damper.

8. The waste receptacle of claim 1 further comprising a second shock absorbing portion extending between the body and a portion of the actuator on an interior portion of the body.

9. A waste receptacle assembly comprising:

a body having an upper end and a lower end, the upper end including an opening for inserting waste into the receptacle;

a lid for selectively covering at least a portion of the opening, the lid pivotably movable with respect to the body;

an actuator positioned exterior to the body adjacent the lower end;

a first linkage arm operably coupled to the actuator;

a second linkage arm operably coupled to the lid;

a third linkage arm positioned intermediate the first and second linkage arms; and a shock absorbing portion positioned between and coupled to the second and third linkage arms, the lid, actuator, first, second, and third linkage arms, and the shock absorbing portion each movable between a first position where the lid is closed and a second position where the lid is at least partially open by pivoting at least a portion of the lid from the body to expose the opening, the shock absorbing portion being expandable between the second and third arms so as to dampen relative motion between the second and third arms, wherein the actuator causes the first linkage arm to move in a generally horizontal direction and causes generally vertical movement of the second and third linkage arms.

10. The waste receptacle of claim 9 further comprising a cam bracket positioned intermediate the first and third linkage arms wherein the actuator is configured to pivot causing the generally horizontal movement of the first linkage arm to the cam bracket, the cam bracket configured to pivot causing the generally vertical movement of the second and third linkage arms.

11. The waste receptacle of claim 9 wherein the shock absorbing portion is not fixed in position relative to the body.

12. The waste receptacle of claim 9 further comprising a cam bracket coupled to the lid, the cam bracket having an arcuate slot permitting the lid to pivot beyond the movement of the actuator such that the lid can remain in an open position.

13. The waste receptacle of claim 9 wherein the shock absorbing portion includes at least one of a spring and a damper.

14. The waste receptacle of claim 9 further comprising a second shock absorbing portion extending between the body and a portion of the actuator on an interior portion of the body.

15. The waste receptacle of claim 9 wherein at least a portion of one of the second and third linkage arms is positioned within a channel of the other of the second and third linkage arms such that the second and third linkage arms are slidable relative to one another.

16. The waste receptacle of claim 9 wherein at least one of the first and second arms includes a rotatable wheel attached thereto to decrease binding between the body and the respective linkage arm.

17. A waste receptacle assembly comprising:

a body having an upper end and a lower end, the upper end including an opening for inserting waste into the receptacle;

a lid for selectively covering at least a portion of the opening, the lid pivotably movable with respect to the body;

an actuator positioned exterior to the body adjacent the lower end, the actuator coupled to and pivotable about a point interior to the body;

a first linkage arm operably coupled to the actuator on the interior of the body and movable in a generally horizontal direction;

a cam bracket coupled to an end of the first linkage arm opposite the actuator; and a second linkage arm having a first end coupled to the cam bracket and a second end opposite the first arm coupled to the lid, the second linkage arm movable in a generally vertical direction, the lid, actuator, first linkage arm, cam bracket, and second linkage arm, each movable between a first position where the lid is closed and a second position where the lid is at least partially open by pivoting at least a portion of the lid from the body to expose the opening.

18. The waste receptacle of claim 17 further comprising a third linkage arm and a shock absorbing portion positioned between the second and third linkage arms.

19. The waste receptacle of claim 17 further comprising a shock absorbing portion extending between the body and a portion of the actuator on an interior portion of the body.

* * * * *